US005868143A

United States Patent [19]

Nielsen

[11] Patent Number: 5,868,143

[45] Date of Patent: Feb. 9, 1999

[54] CIGAR AND CIGARETTE HOLDER THAT ATTACHES TO GOLF BAG

[76] Inventor: Pete G. Nielsen, 1844 Malvern St., St. Paul, Minn. 55113

[21] Appl. No.: 635,634

[22] Filed: Apr. 22, 1996

[51] Int. Cl.[6] ..... A24F 15/00

[52] U.S. Cl. ..... 131/329; 131/328; 131/256; 131/257; 131/175

[58] Field of Search ..... 131/329, 240.1, 131/256, 328, 257, 175; 473/387, 388, 389

[56] References Cited

U.S. PATENT DOCUMENTS 1,802,332 6/1931 Burns ..... 131/240.1

5,423,530 6/1995 Gonzalez ..... 473/387

5,524,646 6/1996 Reich ..... 131/329

*Primary Examiner*—Vincent Millin

*Assistant Examiner*—Charles W. Anderson

*Attorney, Agent, or Firm*—Nawrocki, Rooney & Sivertson, P.A.

[57] ABSTRACT

A plastic device that temporarily holds a cigar or cigarette for a golfer. The device attaches to a golf bag by a clip (13) (14) that the golfer easily slides on to his or her golf bag FIG. 5. Once attached the golfer simply puts his or her cigar into the cigar clamp (10) pushing down until the cigar fits snugly FIG. 2. If using the cigar holder for a cigarette the golfer would place the cigarette in the v-shaped cigarette slot (11) and push down until it is held in place FIG. 3. The holes in the top of the cigar holder (15) may be used to store golf tee's. The hole behind the cigar clamp (16) may be used to hang a towel.

12 Claims, 5 Drawing Sheets

CIGAR AND CIGARETTE HOLDER THAT ATTACHES TO GOLF BAG

BACKGROUND

1. Field of Invention

This invention pertains to smoking on the golf course while allowing the golfer to free up his or her hands without having to put his or her cigar or cigarette down on chemically contaminated grass which might be dangerous to the golfers health.

2. Description of Prior Art

After a extensive search, I have found many golf related accessories (297 of which were patented). None of the prior art I uncovered dealt with cigars and cigarettes in the manner of my invention. (To date.)

OBJECTS AND ADVANTAGES

Several objects and advantages of this invention are:

(a) to provide a temporary holder for a cigar or cigarette so the golfers hands become free;

(b) to provide a temporary holder for a cigar or cigarette that allows the golfer to avoid putting his or her cigar or cigarette down on the grass where it comes into contact with dangerous pesticides and fertilizers;

(c) to provide a temporary holder for a cigar or cigarette that allows the golfer a dry place to set his or her cigar or cigarette if the grass on the course is wet;

(d) to provide one temporary holder for a cigar or cigarette that accommodates all sizes of cigars;

(e) to provide a convenient place to store golf tee's;

Further objects and advantages are to provide a temporary cigar or cigarette holder that is lightweight, weatherproof, and durable.

DRAWING FIGURES

In the drawings, closely related figures have the same number but different alphabetical suffixes.

Figure 1:
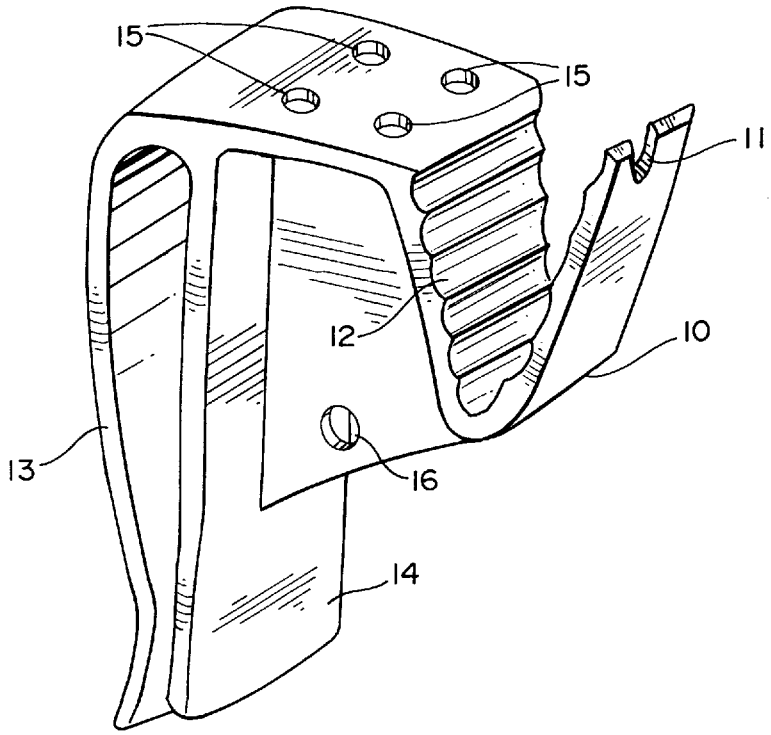
FIG. 1 shows various aspects of the cigar holder.

| Reference Numerals In Drawings | | | |
|---|---|---|---|
| 10 | cigar clamp | 11 | slot for cigarette |
| 12 | circular groove | 13 | back of clip |
| 14 | front of clip | 15 | holes for tee's |
| 16 | hole for towel clip | | |

DESCRIPTION-FIGS. 1–5

The invention is pictured in FIG. 1. It is made of durable but flexible plastic. The flexibility of the plastic is essential to operation of the cigar clamp 10. A cigar holder 16, adjacent clip 13, includes a channel or groove 12 having a varying horizontal width over a height thereof. The channel or groove 12 is formed by a first and a second leg joined at a base of channel 12 and extends upward therefrom, at least one of the legs has a degree of flexibility about the base to adjust the channel width to grasp a cigar placed within the channel without damage to the cigar. The Cigar clamp 10 has grooves 12 and flexibility so it can adjust to different sized cigars easily. The cigar clamp 10 grips the cigar snugly but gently so as not to tear the cigar FIG. 2.

Figure 3:
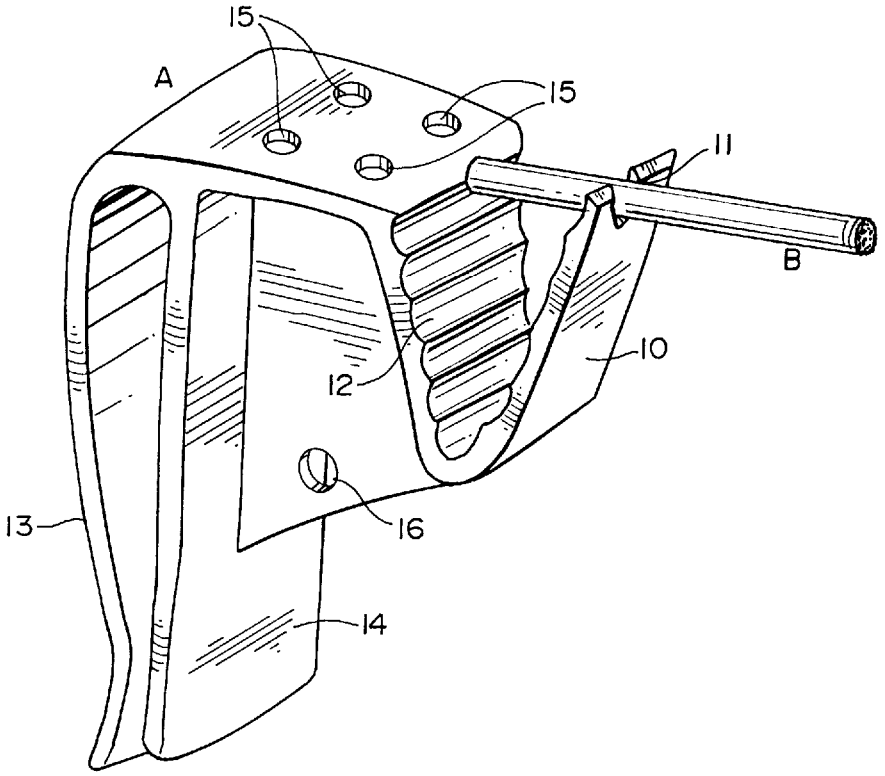
FIG. 3 show the cigar holder with a cigarette in the cigarette slot.

The V shaped slot 11 on the front of the cigar clamp 10 holds a cigarette firmly FIG. 3.

Figure 4:
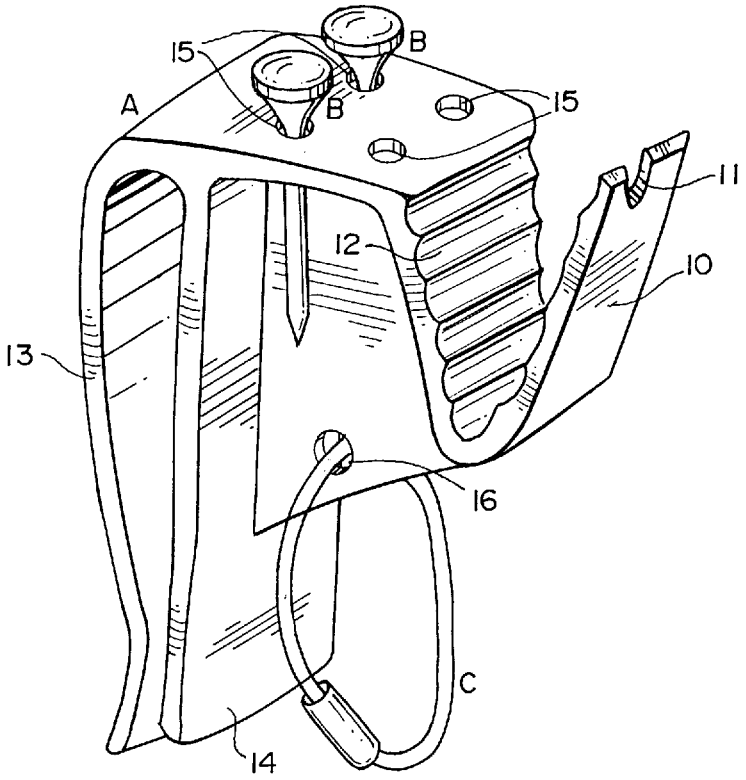
FIG. 4 show cigar holder with golf tee's and towel clip.

There are four holes 15 in the top of the cigar holder for storing golf tee's FIG. 4. This will be very convenient for the golfer. Another hole is found at the base of the cigar holder 16. This allows the golfer to hang his or towel. FIG. 4 is of a typical towel clip.

Figure 5:
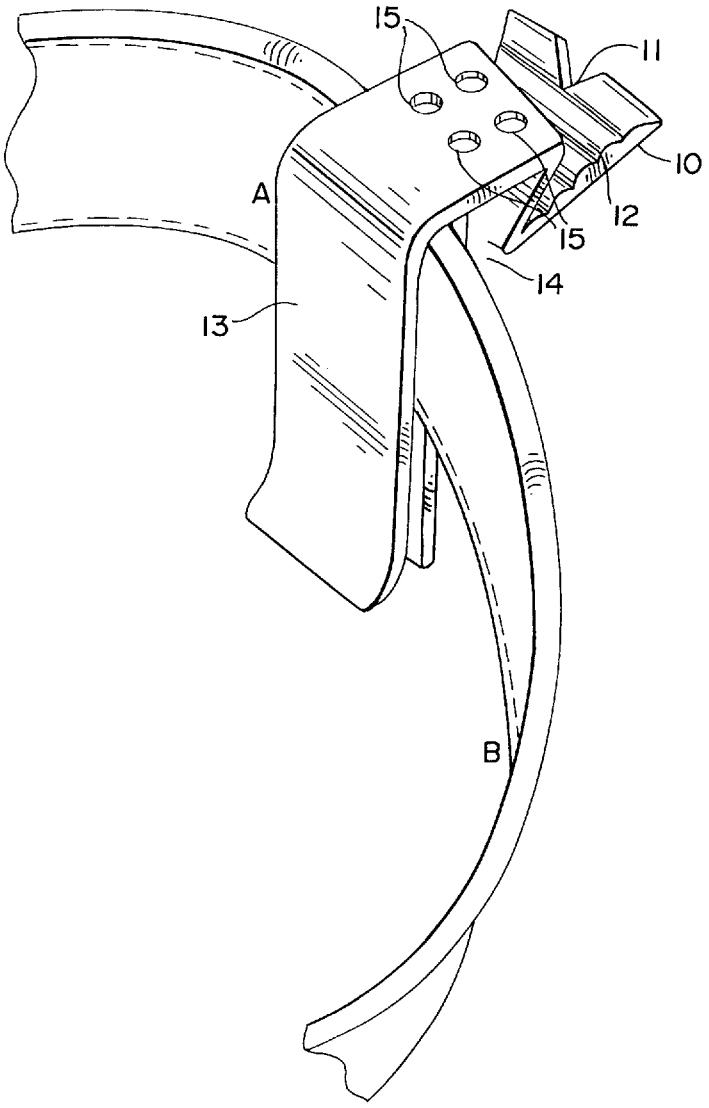
FIG. 5 show the cigar holder attached to a golf bag.

The back of the clip 13 is placed on the inside of the golf bag FIG. 5. The clip 13/14 is flexible so it will fit on all sized golf bags easily.

From the previous description, a number of advantages of my cigar holder become evident:

(a) The entire device is made of plastic, this will inexpensive to produce.

(b) being composed of plastic will make the cigar holder rustproof, this is an important feature to golfers who can't always depend on good weather.

(c) The cigar holders adjust to all sized cigars and golf bags.

OPERATIONS-FIGS. 1, 2, 3, 4, 5

The operation of the cigar holder is very simple, slide the clip 13/14 (FIG. 5) over the top edge of a golf bag. The back of the clip 13 should be on the inside of the golf bag and the front of the clip 14 should be on the outside.

Figure 2:
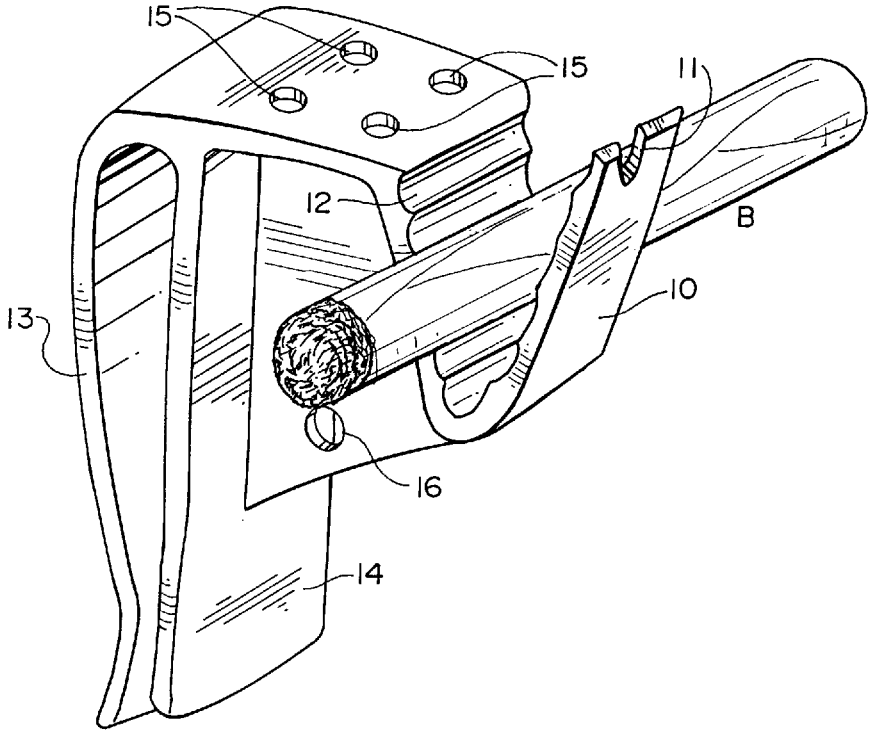
FIG. 2 show the cigar holder with cigar in cigar clamp.

If using the cigar holder for a cigar FIG. 2 push the cigar down into the cigar clamp 10 until the desired fit is achieved.

If using the cigar holder for a cigarette FIG. 3 push the cigarette into the V shaped cigarette slot 11 on the front of the cigar clamp 10 until there is a snug fit.

FIG. 4 shows the cigar holder equipped with golf tee's.

SUMMARY, RAMIFICATION, AND SCOPE

This invention will offer a solution to a problem that is becoming more prevalent. The problem being the health of smokers on the golf course. Although smoking in itself is dangerous, the pesticides and fertilizers used on the grass of the golf course are equally dangerous.

The cigar holder offers advantages that are as follows:

it offers a temporary place to set a cigar or cigarette instead of setting the cigar or cigarette in the grass where it comes in contact with dangerous chemicals;

it is made of affordable plastic;

it will not rust;

it adjusts to all sized cigars and golf bags;

it offers a convenient place to store golf tee's;

it is very easy to use.

I claim:

1. A golf bag accessory for temporarily holding a cigar or cigarette thereon comprising:

(a) a main body portion having a clip extending vertically therefrom, said clip slidably receivable over a top rim of a golf bag; and (b) a cigar holder adjacent said clip, said cigar holder including a channel having a varying horizontal width over a height thereof, said channel formed by a first and a second leg joined at a base of said channel and extending upward therefrom, at least one of said legs having a degree of flexibility about said base to adjust said channel width to grasp a cigar placed within said channel without damage to said cigar.

2. The golf bag accessory of claim 1, wherein said channel is generally V-shaped.

3. The golf bag accessory of claim 1, further comprising a plurality of grooves on opposing faces of said legs for aiding in securing said cigar therebetween.

4. The golf bag accessory of claim 1, further comprising a golf tee holder on said main body portion having a plurality of holes through said body portion for releasably securing a plurality of tees therethrough.

5. The golf bag accessory of claim 1, further comprising means for hanging a towel from said main body portion, said means including a bore through said body portion receiving a towel clip.

6. The golf bag accessory of claim 1, wherein said accessory is integrally molded from a plastic material.

7. A golf bag accessory for temporarily holding a cigar or cigarette thereon comprising:

(a) a main body portion having means for attachment to a golf bag rim extending therefrom; and (b) a cigar holder adjacent said means for attachment to a golf bag rim, said cigar holder including a generally V-shaped channel having a height defined by and extending horizontally between a first and a second leg joined at the apex of said V-shaped channel, at least one of said legs having a degree of flexibility about said apex to grasp a cigar placed within said channel without damage thereto.

8. The golf bag accessory of claim 7, wherein said legs of said generally V-shaped extend vertically at an angle to form a channel of varying width.

9. The golf bag accessory of claim 7, further comprising a plurality of grooves on opposing faces of said legs for aiding in securing said cigar therebetween.

10. The golf bag accessory of claim 7, further comprising a golf tee holder on said main body portion having a plurality of holes through said body portion for releasably securing a plurality of tees therethrough.

11. The golf bag accessory of claim 7, further comprising means for hanging a towel from said main body portion, said means including a bore through said body portion receiving a towel clip.

12. The golf bag accessory of claim 7, wherein said accessory is integrally molded from a plastic material.

* * * * *